United States Patent [19]

Lamansky

[11] Patent Number: 4,482,132

[45] Date of Patent: Nov. 13, 1984

[54] NAIL REMOVING HAMMER

[76] Inventor: Daniel R. Lamansky, R.R. 4, Box 250, Fairfield, Iowa 52556

[21] Appl. No.: 421,234

[22] Filed: Sep. 22, 1982

[51] Int. Cl.[3] ..... B25C 11/00

[52] U.S. Cl. ..... 254/26 R

[58] Field of Search ..... 254/25, 26 R, 21; 145/30 R

[56] References Cited

U.S. PATENT DOCUMENTS

| | | | |
|---|---|---|---|
| 638,341 | 12/1899 | Knight | 145/30 R |
| 675,823 | 6/1901 | Edmands | 145/30 R |
| 701,076 | 5/1902 | McGinty | 145/30 R |
| 822,943 | 6/1906 | Gorsuch | 254/25 |
| 838,865 | 12/1906 | Kihlmark | 254/26 R |
| 899,287 | 9/1908 | Blakeley | 254/26 R |
| 994,775 | 6/1911 | Nelson | 254/26 R |

*Primary Examiner*—Robert C. Watson

*Attorney, Agent, or Firm*—Seiler, Quirk & Tratos

[57] ABSTRACT

A hammer has a nail-removing claw located at a top portion of the hammer head between the poll and the handle. The novel claw is a pair of opposing jaws defined by a rearwardly opening V-shaped slot which is accessible from the side and rear of the hammer head. A second novel nail-removing claw is located in the throat of the hammer head between the poll and the handle. This claw consists of a pair of opposing jaws defined by a downwardly opening V-shaped slot.

7 Claims, 13 Drawing Figures

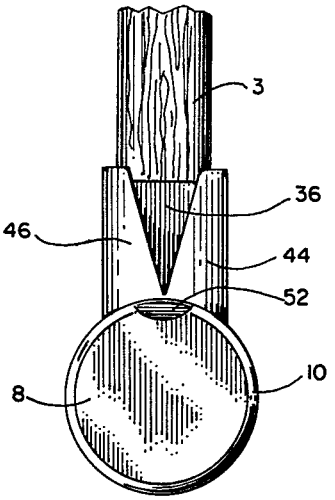
FIGURE 6.
FIGURE 7.
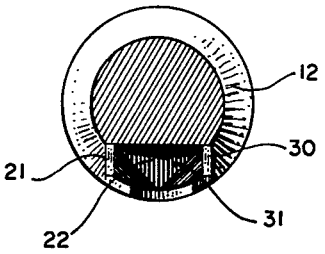
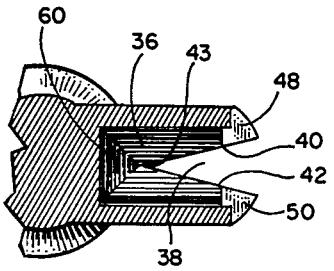
FIGURE 8.
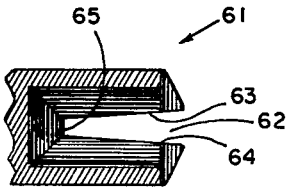
FIGURE 9.
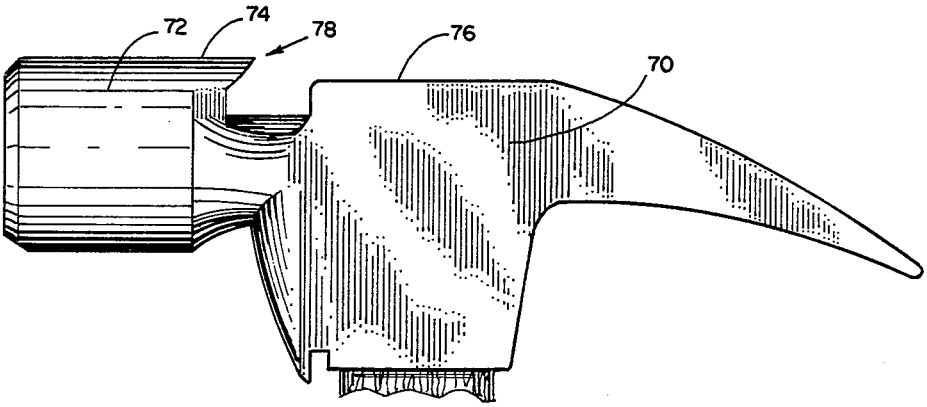
FIGURE 10.

NAIL REMOVING HAMMER

RELATIONSHIP TO OTHER CASES

This invention is a continuation-in-part of U.S. application Ser. No. 391,528, filed June 24, 1982, now abandoned and entitled Nail Removing Tool.

BACKGROUND OF THE INVENTION

This invention relates to a nail-removing hammer which has at least one nail-removing means in addition to a conventional rearwardly extending claw. A claw comprising a rearwardly opening V-shaped slot located at the upper rear portion of the hammer poll provides an excellent mechanical advantage for removing, or starting to remove, heavy nails. An additional nail-removing claw located in a forward throat portion of the hammer head can be used to complete the removal of long nails. In a preferred embodiment, the claw consists of a downwardly opening V-shaped slot.

Most commonly available hammers have a nail-removing claw located at a rear portion of the hammer body or head. Standard carpenter's hammers include rip-claw or straight-claw hammers, generally used for framing type work, and curved-claw hammers, which are used for finish work. A well-cnown problem with the standard straight-claw hammer is its inability to remove long nails easily or quickly; once the nail is removed in the forked claw to a distance of about one inch, leverage is lost, and the hammer head actually becomes the fulcrum for further removal. As the head rolls over, leverage is lost, and the nail bends at an extreme angle instead of being removed. This is a particular problem when removing larger nails, e.g., in the *6d-16d* size.

In addition, hammers having standard claws are generally limited in mechanical advantage for pulling nails. Nails which are particularly difficult to remove, such as large nails, glue-coated nails, or nails having ribbed shanks, are particularly problematic for conventional clawed hammers because the nail is located at a relatively long distance from the fulcrum of rotation, thereby requiring a very large rotational force to begin the nail removal process. With the top claw of the hammer of the invention, a much improved mechanical advantage is obtained for removing nails of this sort. In addition, conventional hammers have difficulty removing nails having heads which are embedded well into the surface into which they are driven, because the claw tips are relatively blunt and difficult to wedge under the embedded head. In such cases, a separate tool known as a "cat's paw" is used to drive underneath the embedded nail head to begin the removal process. The top claw on the hammer of the invention is fashioned in such a manner as to be useful as a cat's paw, with the claw edges being relatively easy to drive underneath a nail head.

Other problems with conventional hammer claws relate to the removal of relatively long nails, or nails which have already been partially removed from the wood. When driving nails, weaker nails such as galvanized nails tend to bend, especially when being driven into hard woods or near a knot in the wood; the bent nails must of course be immediately removed. Long nails are used in the assembly of scaffolding, bleachers, concrete form work, and the like, and must be removed upon disassembly. For this type of nail removal, it is often necessary for a carpenter to use a special nail-pulling tool in addition to the hammer, or to find a block of wood or other object to place underneath the head of the hammer to raise the fulcrum point above the wood surface for greater leverage. This latter method is somewhat inefficient, and sometimes results in instability, with the hammer handle pulling off to one side. Nails driven in tight areas, or driven on a slant, glue-coated nails, and ribbed nails present additional difficulties. These problems can cause frustration and lost time if a carpenter needs to descend from a ladder or scaffold to search for a wrecking bar or piece of wood to use in removing a recalcitrant nail.

The problem of removing long nails with standard-claw hammers has been recognized for many years. One approach to solving the problem is to have a movable able arm which extends outwardly from the top of the hammer and which can act as a fulcrum (thus replacing the block of wood) when pulling long nails. Examples of tools having this capability are shown in Thayer, U.S. Pat. No. 35,715, Shepard, U.S. Pat. No. 587,242, Palmer U.S. Pat. No. 856.097, Frey, U.S. Pat. No. 1,125,999, Eveleth, U.S. Pat. No. 540,967, and Rairden, U.S. Pat. No. 1,132,879. While these devices provide additional leverage for removing long nails, the requirement of having moving parts generally makes the hammers somewhat more expensive and less durable. In addition, each time a long nail must be removed, the hammer must be adjusted to provide for the extended fulcrum.

It is also known to incorporate various types of nail-extracting devices in addition to or in replacement of a standard claw for hammers or similar hand tools. For example, in David, U.S. Pat. No. 3,150,858, a straight-claw hammer having two additional claws with openings circumferential to the hammer head is disclosed. The nail is removed by engaging the head in the claw and rotating the hammer about the axis of the hammer head, in effect wrapping the nail around the hammer body. Additional torque must be applied by hand since the fulcrum is off-center to the handle. Furthermore, this device is not adapted to remove nails in tight places. Similar devices showing claws which engage the nail and are rotated about the body axis to remove the nail are found in Darr et al, U.S. Pat. No. 1,600,275, and Chase, U.S. Pat. No. 516,644. In Thorson, U.S. Pat. No. 1,656,652, Darr et al, U.S. Pat. No. 1,600,275, and Andersen, U.S. Pat. No. 1,713,810, tools are disclosed having notches in side portions of conventional hammer claws which are used to engage nails for removal. Both of these tools are used in the standard manner, i.e., rotation of handle over head, as is experienced with a conventional claw hammer. A further unusual claw design including a plurality of transverse slots in a rearwardly extending claw member is disclosed in Connor, U.S. Pat. No. 3,963,215.

A need exists for a hammer which has no moving parts and which can easily and quickly extract long nails. Furthermore, a need exists for a claw design in which the nail-removing surface rests directly under the head of a nail, simultaneously exerting upward force on the shaft and entire underface of the nail head, thus reducing the chances of the nail head bending or popping off. In accordance with the invention, a hammer is provided which can pull almost any size nail, including "duplex" or "scaffold" nails without the need for separate tools. With the hammer of the invention, there is no need for the use of a crowbar or a block of wood for additional leverage.

Furthermore, there is a need for a nail-holding hammer which can grip a nail prior to the nail being hammered into place. In many instances, a carpenter will find himself elevated on a ladder or scaffolding, with a need to use one hand to provide leverage, to maintain balance, or to hold on to a stationary object for his own safety. Ordinarily, a user will hold the nail with one hand and the hammer with the other hand, striking the nail a first blow while the nail is being held in the other hand. If the nail could be held by the hammer for the first blow, it would permit use of the other hand for safety purposes. Furthermore, the ladder or scaffold could be moved less frequently, since the carpenter would be able to reach father from the support to drive nails. The hammer of the invention provides these advantages.

Accordingly, it is an object of the present invention to provide a hammer for the rapid and easy extraction of long nails. It is a further object of the invention to provide a versatile tool having no moving parts and having a plurality of nail-extraction means for nails of different lengths and different difficulties of removal. It is yet a further object of the invention to provide a claw hammer which provides substantially greater leverage than conventional hammers for removal of long nails. It is another object of the invention to provide a hammer having a nail extracting claw which is also useful to hold a nail prior to, and during the initial impact of insertion of the nail into an object. These and other objects of the invention are provided by the nail-driving and nail-extracting device disclosed herein.

BRIEF SUMMARY OF THE INVENTION

A nail-removing hammer has an additional nai-removing means at a rear portion of the hammer poll. The nail-removing means comprises a nail-head receiving chamber having walls, with a rearwardly opening V-shaped slot provided to engage the nail shank. A second claw useful for pulling long nails exists in the throat portion of the hammer head. This claw also consists of a nail head receiving chamber and a V-shaped slot in a wall thereof for engaging the nail shank; in a preferred design, the V-shaped slot opens downwardly, i.e., in the direction of the extension of the hammer handle. Removal of the nail with the top claw is effected by sliding the edges of the top claw slot under the nail head until the edges engage the nail shank, and rotating the hammer handle in a handle-over-head direction. Removal of a nail with the throat claw is effected by engaging the nail in a similar manner in the downwardly opening claw, and rotating the hammer handle in a head-over-handle direction.

BRIEF DESCRIPTION OF THE DRAWINGS

The invention is best understood with reference to the drawings, in which:

FIG. 6 is an inverted front view;

FIG. 7 is a partial section view taken along section line 7—7;

FIG. 8 is a partial section view of the throat claw taken along section lines 8—8;

FIG. 9 is a section view of an alternate embodiment of the throat design siminlar to the design shown in FIG. 8;

FIG. 10 is a side view of an alternate embodiment of the invention showing a top claw raised above the upper surface of the head;

DETAILED DESCRIPTION OF A PREFERRED EMBODIMENT

Figure 1:
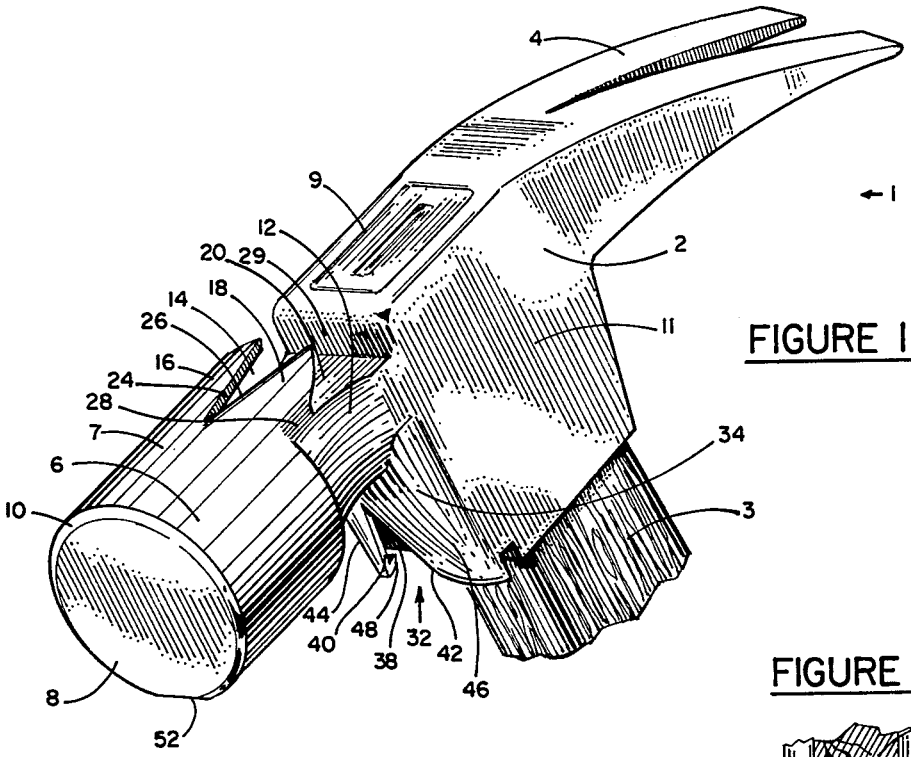
FIG. 1 a partial perspective view of a hammer of the invention showing both claws of the invention in addition to a conventional claw.

Referring to FIG. 1, a nail extracting hammer of the invention has a head 2, a wood handle 3, and a standard, rearwardly extending, forked claw 4. A strike portion or poll 6 having a strike face 8 is located at the forward portion of the hammer head. The poll is circular, and has an upper rounded surface 7. A chamfered surface 10 around the edge of the poll face serves as a pivot point when either of the two novel nail-removing claws of the invention are used. An internal bore or socket 9 extends through the hammer head body to receive the wood handle 3. The side portion or cheek 11 of the hammer head forms partial walls of the socket. A neck portion 12 extends between the rear of the poll and the remainder of the head body. For descriptive purposes, the poll portion of the hammer head is referred to as the forward portion, and the conventional forked claw portion is referred to as the rearward portion. Similarly, the top of the poll is described as the upper portion of the head whereas the socket entrance where the wood handle inserts is considered to be the lower portion of the head. This description, which is for convenient reference purposes only, should not be considered as limiting. Similarly, while the hammer is described as shown with a metal head and wood handle, the invention is equally applicable to any hammer, such as a single-piece forged or cast metal hammer.

In addition to the conventional rearwardly extending nail-extracting claw 4, the hammer of the invention has two additional nail-removing means. The first additional nail-removing means is a V-shaped slot in the upper surface of the hammer opening rearwardly from the rear portion of the poll. A second nail-removing means is a downwardly opening V-shaped slot in the throat portion of the hammer head. Each of these claws provides particular advantages of convenience, versatility, and mechanical advantage which is not available in conventional hammers.

A first additional nail-removing means 14 is located at the rearward portion of the poll at the upper surface of the hammer. The claw is located rearwardly of the poll but forwardly of the axis of the hammer handle or an extension thereof, thus being in an optimum position for hard-to-remove nails. Nail-removing means 14 is a pair of jaws defined by a centrally located, V-shaped slot which opens rearwardly, i.e., in which the apex of the "V" points forwardly toward the poll face. The V-shaped slot or notch is symmetrically located transversely across the width of the hammer head such that a plane longitudinally intersecting the hammer head would bisect the "V" of claw 14 and also claw 4. Nail-removing means 14 is formed by a pair of rearwardly extending teeth or flanges 16 and 18, with the slot being formed by edges 24 and 26 of the teeth. A transverse channel 20 extends across the upper portion of the neck of the hammer head, thereby providing access to the opening of the "V" for a nail to be removed from the sides of the hammer. A head-receiving chamber or socket 22 extends forwardly from the transverse channel 20 and underneath the teeth of the nail-removing means to permit the head of the nail to be engaged in the claw.

Figure 2:
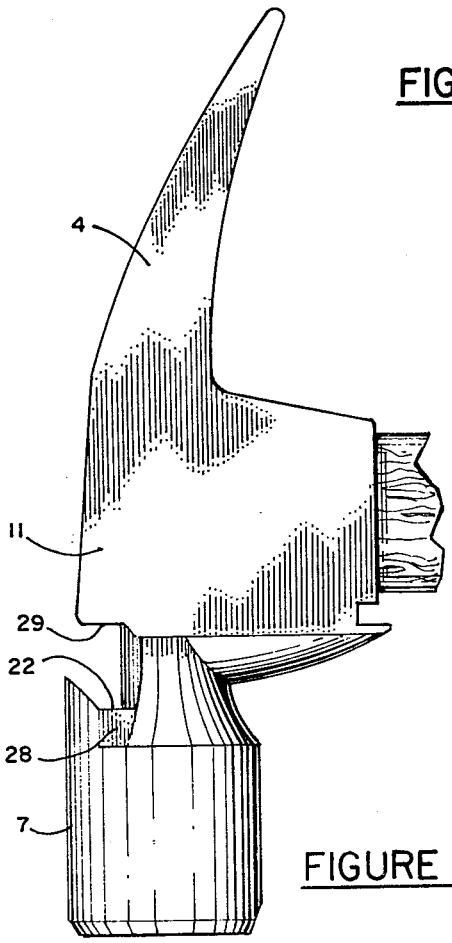
FIG. 2 is a side view thereof.
Figure 3:
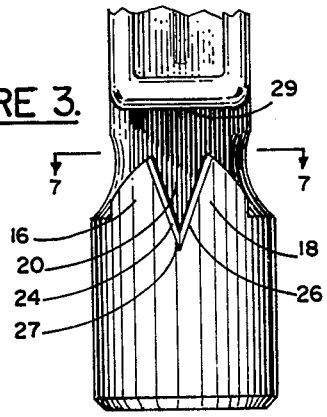
FIG. 3 is a partial top view of the hammer showing the top claw.
Figure 5:
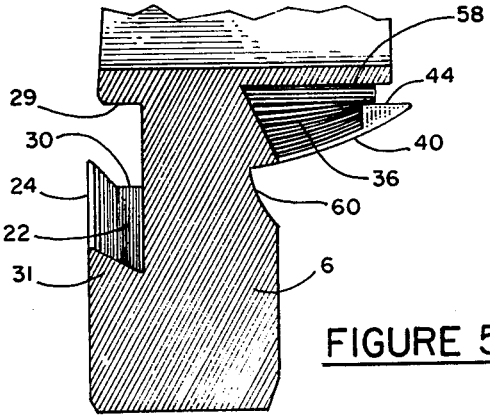
FIG. 5 is a partial side section view of the head showing both claws.

As seen in FIGS. 2 and 3, which show side and top views of the novel top claw of the invention, respectively, a nail to be removed using this claw is accessible to the claw from either side of the hammer head or from the top of the hammer head, i.e., the hammer head can be lowered directly vertically over the nail head to be removed, and the head is then slid rearwardly to engage the nail head in the claw. The nail head receiving chamber 22 is formed on the top by teeth 16 and 18, and by side walls 28 and 30 (see FIG. 5), front wall 31, and rear wall 29. In using the top claw, the upper portion of the embedded nail is grasped in the claws, and the hammer is rotated in a handle-over-poll direction, which is the same direction used for removing nails with a conventional claw. Because the upper claw is located between the center line of the hammer handle and the pivot point of rotation, an excellent mechanical advantage for removal of heavily embedded nails is obtained. In addition, the upper claw can be used in a manner similar to a "cat's paw", with a distinct advantage over a conventional claw for removing nails having heads embedded at or below the surface into which the nails have been driven. FIG. 7 shows a partial section view of the nail-receiving chamber 22 taken along section lines 7—7 of FIG. 3, shown inverted in nail-removing position. This figure shows the formation of the chamber by walls 28, 30, and 31.

A second novel nail-removing means is located in the throat portion 34 of the hammer and is best seen in FIGS. 1, 4, 5, 6, and 8. The nail-removing claw is generally defined by a curved forward wall, a flat rearward wall, and an upper wall, which walls define a chamber for receiving the head portion of the nail to be removed. The nail head is inserted into the chamber through nail-removing means comprising a pair of jaws defined by a V-shaped slot 38 similar to the slot at the rear of the poll. Head-receiving chamber 36 is formed by walls, including a flat rear wall 58, a slightly angled top wall 60 (see FIG. 5), and the front wall of throat 34. The front wall has a pair of teeth 44 and 46 defined by a V-shaped slot 38 having edges 40 and 42 converging at point 43. The V-shaped slot open downwardly toward the extension of the hammer handle. These teeth provide the gripping means for nails to be extracted. A pair of lugs 48 and 50 at the lower end of the teeth extend inwardly partially into the head-receiving chamber to prevent the nail head from slipping out of the chamber as removal occurs.

The throat claw is useful primarily for removing long nails in the manner described in my application copending U.S. Pat. Ser. No. 391,528. Once a long nail has been partially removed, the nail head is gripped in the teeth of the throat claw by sliding the head along the V-shaped slot toward the apex, and rotating the hammer in poll-over-handle direction (i.e., in a direction opposite to the rotation of removal of a nail with a conventional rearwardly extending claw), using the top edge of the poll face as a fulcrum. The nail shaft extends forwardly of the hammer poll, with the shaft abutting the poll in a flat bevelled surface 52 best seen in FIGS. 4 and 6. This slight bevelling at the underside of the poll near the strike face keeps the nail from sliding along the curved surface as it is being pulled.

Figure 4:
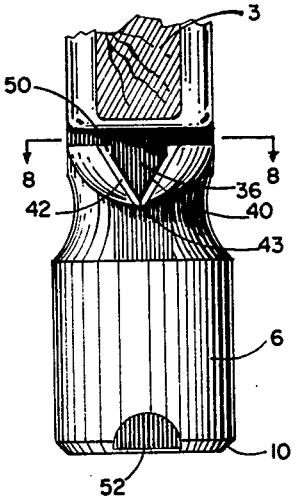
FIG. 4 is a partial bottom view showing the throat claw.

A partial section view taken along section lines 8—8 in FIG. 4 shows an interior view of the nail head receiving chamber 36. In FIG. 9, a slightly modified embodiment of the throat claw is shown in a view similar to that shown in FIG. 8. The modified throat claw 61 has a chamber having a forward slot opening 62 formed by tapered edges 63 and 64. Instead of the edges approaching an apex 43 as shown in FIG. 8, the V-shaped claw has a slightly flat forward surface 65 as shown in FIG. 9. This claw is considered functionally similar, and the converging of the claw edges to a single point is considered unnecessary in view of the fact that this claw is useful only for long, large nails, generally over **10*d*** in size. The narrower angle of the slot opening also assists in holding nails more firmly.

Another embodiment of the nail-extracting hammer of the invention having a slightly modified upper claw is shown in FIG. 10. Hammer head 70 has a novel upper claw 78 located behind poll 72. Whereas in the embodiment of the invention shown in FIG. 1 the upper surface of the poll is approximately co-planar with the upper surface of the socket portion of the hammer head, in the embodiment shown in FIG. 10 the upper surface 74 of the poll is slightly elevated above the upper surface 76 of the head. This design facilitates engagement of a nail with the upper claw by sliding the head rearwardly to permit the slot to engage the nail shaft. With this alternate design, the upper surface 76 of the hammer head will not interfere with the engagement of the nail slot even if the nail is partially elevated from the embedding surface.

Figure 11:
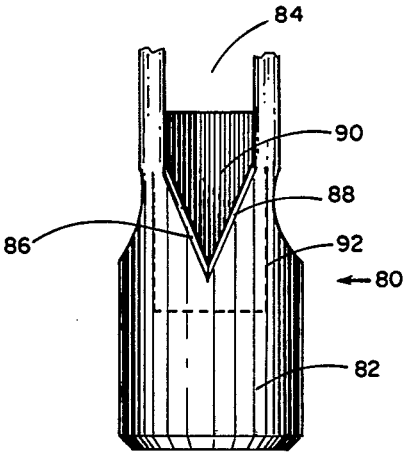
FIG. 11 is a partial top view of an alternate embodiment wherein the nail is insertable into the top claw only through the top or rear portions of the hammer head.
Figure 12:
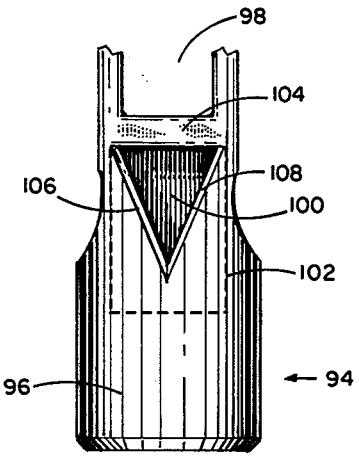
FIG. 12 is another embodiment wherein the top claw is accessible to a nail head only through the top portion of the hammer head.
Figure 13:
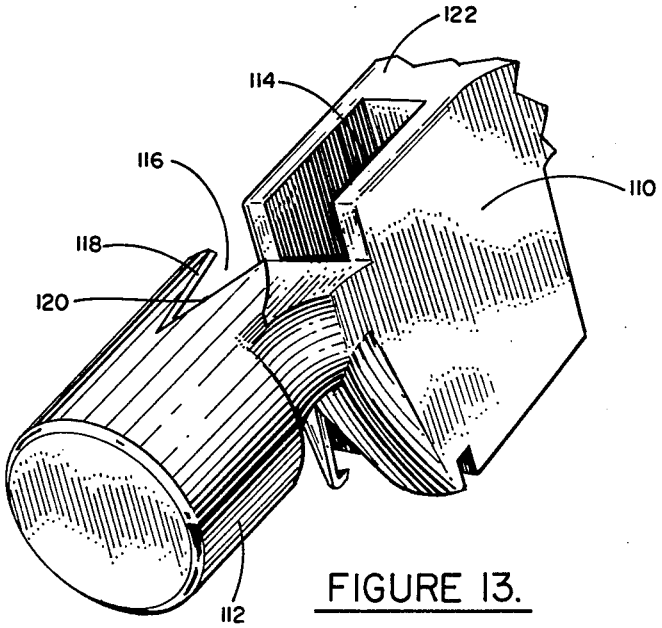
FIG. 13 is another alternative embodiment showing accessibility of the nail head to the top claw through the top, sides, or rear of the head.

Various embodiments of the upper poll claw which enable access of a nail head into the claw from various directions are shown in FIGS. 11 through 13. In FIG. 11, head 80 has a claw formed in the rear of poll 82 by slot edges 86 and 88. A chamber 90 is formed by a floor, solid side walls, and a top wall in which the V-shaped slot is cut. The chamber does not have a forged rear wall, with the handle socket 84 forming a portion of the chamber. When the handle is in place in the socket, the handle may form the rear chamber wall. In this design, a nail may be inserted into the claw only through the top of the hammer handle, although additional room is provided at the rear of the chamber to slide the nail into the slot. The chamber wall outline is shown by phantom line 92. In the embodiment of the upper claw as shown in FIG. 12, head 94 has a claw formed by slot edges 106 and 108 at the rear of poll 96. The head-receiving chamber 100 having its walls outlined by phantom line 102 is accessible only through the triangular opening at the top of the hammer. A rear chamber wall 104 separates the chamber from the handle socket 98. This design is satisfactory for most nail removing situations, since ordinarily access of the nail shaft will be vertically through the top portion of the hammer.

An alternate design showing accessibility to the top claw through not only the top of the hammer but also through both sides and also the rear is shown in FIG. 13. This design is very similar to the design shown in FIG. 1, except that the head-receiving chamber 116 does not have a rear wall 29 as shown in FIG. 1. In this design, head 110 has poll claw defined by slot edges 118 and 120 located behind 112. In this design, a nail head can be inserted into the slot from either side of the hammer, from the top of the hammer, or from the rear of the hammer. This design may afford some certain advantages from a standpoint of drop forging the hammer head, and in some instances may also be easier to slide nails into the slot from the rear of the hammer. This design additionally affords the option of the use of a handle which extends all the way to the top surface 122 of the head, or which may extend into the socket to a lesser distance. This same option may be used for the design shown in FIG. 11.

Use of the novel nail extracting claws described herein is similar to the use of a conventional claw of a hammer. The top claw, which is particularly useful for heavily embedded nails, ribbed nails, or glue-coated nails, is used by engaging the nail head in the slot, sliding the hammer rearwardly until the jaws of the slot engage the nail shaft, and rotating the handle of the hammer over the poll using the edge of the poll face as a fulcrum, thereby lifting the nail from the surface. In the event that the nail is too long to be removed entirely by the top claw, removal can be completed through the use either of the conventional claw 4 or of the throat claw. The throat claw is generally used to remove very long nails, such as those over 10*d* in size. Initial removal of the nail is accomplished with the standard claw 4 or the top claw. After removal to an extent sufficient to be able to engage the the head of a nail in the throat claw, the throat claw is slid in place by moving the slot 38 transverse to the nail shaft until the jaws of the claw grip the shaft. Then, the hammer handle is rotated over the rearward claw, i.e., in a poll-over-handle direction, with the nail shaft abutting the bevelled surface 52 just behind the lower portion of the strike face of the hammer.

An additional and unexpected benefit of the throat claw of the invention involves the use of the nail gripping jaws for the initial placement of the nail into an object. To accomplish this end, the head of a nail to be driven is inserted into the jaws of the throat claw until the jaws grip the nail shaft with the nail head abutting the rear wall of the head receiving chamber 58. With the nail shaft firmly gripped in the jaws, the hammer is then given a normal forward thrust in a manner similar to striking a nail. The nail head, which extends forwardly of the strike face of the poll, will become embedded in the object to be nailed, with the rear chamber wall serving as the striking face to impact the nail into the object. At this point, the jaw can be removed from the nail shaft and the nail driven conventionally. This process for starting the driving of a nail can be very useful in situations where it is difficult to use both hands to start the nail, such as when the user desirably needs one hand to maintain balance or to hold on for safety on scaffolding or in elevated locations, or when starting a nail in an extremely hard (e.g., metal) surface where it is desirable to have both hands away from the nail. The top claw may also be used in this same manner, with the bottom wall of the channel of the top claw being used as the striking surface.

While the embodiments of the invention disclosed herein show separate nail-extracting claws located at the top and in the throat of the hammer, a hammer having only either one of the two claws disclosed would still be a substantial advance in the art. In addition, many modifications and variations of the nail extracting hammer disclosed herein will be apparent to those skilled in the art within the spirit and scope of the invention. Accordingly, the foregoing description of preferred embodiments of the invention should be considered illustrative rather than limiting and the invention should be defined only by the following claims.

I claim:

1. A nail removing hammer having a head portion and a handle having an axis extending outwardly from a lower neck portion of the head, the head comprising a forwardly extending poll having a nail striking face, and a rearwardly extending nail-extracting claw, nail-removing means located at the upper surface of the head at a rear portion of the poll comprising a pair of opposing jaws defined by a rearwardly opening V-shaped slot, a transverse channel extending across the entire width of a rear portion of the poll recessed below the upper surface of the hammer, said jaws extending rearwardly over said channel, second nail-removing means located in a throat portion of the head immediately forward of the neck portion comprising a second pair of opposing jaws defined by a downwardly opening V-shaped slot.

2. The hammer of claim 1 wherein the nail-removing means also comprises a nail-head receiving chamber having front and side walls, said chamber having a rearward opening to permit access of a nail head into the chamber.

3. The hammer of claim 2 wherein the head-receiving chamber is also defined by a top wall having a rearwardly opening V-shaped slot therein.

4. The hammer of claim 1 wherein the nail-head receiving chamber is defined by front, side, and top walls, and wherein the nail-removing means also comprises a port in the top wall of the chamber defined partially by a V-shaped slot, said port comprising the sole access to said chamber.

5. The hammer of claim 1 wherein the second nail-removing means comprises a second nail-head receiving chamber having rear and side walls and having an opening at a downward portion thereof to permit access of a nail-head to said chamber.

6. The hammer of claim 5 wherein the downwardly opening V-shaped slot is formed in a forward wall of the second nail-head receiving chamber.

7. The hammer of claim 5 wherein the rear wall is flat.

* * * * *